United States Patent [19]

Micciche

[11] 4,198,308

[45] Apr. 15, 1980

[54] MANUFACTURE OF FREE-FLOWING FABRIC SOFTENING DETERGENT

[75] Inventor: Giovanni Micciche, Aprilia, Italy

[73] Assignee: Colgate Palmolive Company, New York, N.Y.

[21] Appl. No.: 928,630

[22] Filed: Jul. 21, 7978

Related U.S. Application Data

[63] Continuation of Ser. No. 830,781, Sep. 6, 1977, abandoned, which is a continuation of Ser. No. 658,802, Feb. 17, 1976, abandoned, which is a continuation of Ser. No. 381,896, Jul. 23, 1973, abandoned.

[51] Int. Cl.[2] ..... C11D 3/065; C11D 11/02

[52] U.S. Cl. ..... 252/135; 252/8.7; 252/8.9; 252/174.16; 252/174.22; 252/540; 252/DIG. 17

[58] Field of Search ..... 252/89, 8.7, 8.9, 135, 252/540, 384, DIG. 17

[56] References Cited

U.S. PATENT DOCUMENTS

| | | | |
|---|---|---|---|
| 3,033,889 | 5/1962 | Chiddix et al. | 252/89 R |
| 3,168,478 | 2/1960 | Stefen et al. | 252/135 |
| 3,341,451 | 12/1967 | Dziuba et al. | 252/8.6 |
| 3,738,943 | 6/1973 | Ramero | 252/540 |
| 3,741,913 | 6/1973 | Waag | 252/89 |

*Primary Examiner*—Mayer Weinblatt
*Attorney, Agent, or Firm*—Norman Blumenkopf; Herbert S. Sylvester; Murray M. Grill

[57] ABSTRACT

Normally tacky and poorly flowing detergent compositions containing polyethoxylated phosphoric ester detergent-fabric softeners are made freer flowing by addition of certain higher aliphatic alcohol polyethoxyethanols to the crutcher mix before spray drying.

8 Claims, No Drawings

MANUFACTURE OF FREE-FLOWING FABRIC SOFTENING DETERGENT

This is a continuation of application Ser. No. 830,781, filed Sept. 6, 1977, which in turn is a continuation of application Ser. No. 658,802, filed Feb. 17, 1976, which in turn is a continuation of application Ser. No. 381,896, filed July 23, 1973, all now abandoned.

This invention relates to heavy duty laundry detergents containing mixed organic esters of phosphoric acid which impart softness to washed textiles and laundry. More particularly, the invention is of a method of spray drying such compositions, which normally tend to be tacky and poorly flowing because of their phosphoric acid ester content, with a functional nonionic compound, added to the crutcher mix, to improve flow properties of the spray dried beads.

It has recently been discovered that mixtures of mono- and diesters of higher aliphatic alcohol polyethoxyethanols and phosphoric acid, preferably in salt form, are useful constituents of built synthetic organic laundry detergents. In addition to their detersive properties, such compounds impart softness to the washed laundry and avoid "hard" feel often noticed after the washing of fabrics with heavy duty built synthetic organic detergents. It has been found that consumers respond very favorably to detergent-softeners containing the phosphoric esters. In using them, there is no need to add softener to the rinse water nor is there any requirement for softening articles or compositions in the laundry dryer. Furthermore, unlike detergent products which contain excesses of cationic material, such as quaternary ammonium halides, e.g., distearyl dimethyl ammonium chloride, there is no danger of discoloration or yellowing of the laundry being washed nor is there any diminution of the detergency of the washing compositions. However, one of the drawbacks in the use of the mixed phosphoric ester detergent-softeners is that the products tend to be tacky when spray dried from a normal crutcher mix. Therefore, until the present invention it has been usual to blend various powdered ingredients, admix liquids with them and micropulverize or otherwise size reduce the resulting mixture to a finely divided form. However, spray dried beads, if free flowing, are generally preferable to such pulverulent materials and therefore attempts have been made to spray dry such detergents. Unfortunately, it appears that even very small quantities of the phosphoric esters tend to migrate to the surfaces of the detergent beads and cause tackiness, lumping and development of poor flow properties. Now, surprisingly, it has been discovered that by the addition of a most unlikely type of material in the crutcher, spray dried beads are obtainable which are initially free flowing and remain so even after lengthy periods of storage.

In accordance with the present invention a method of producing free flowing spray dried built heavy duty synthetic organic detergent compositions containing mixed mono- and diesters of phosphoric acid and higher alkoxy polyethoxyethanol, in salt form, which function to soften fabrics, synthetic anionic organic detergent and inorganic builder salt for such detergent comprises admixing with such materials in an aqueous crutcher mix from which the composition is to be spray dried, from 20 to 200% of the total content of such mono- and diester, of a higher aliphatic alcohol polyethoxyethanol wherein the alcohol is of 14 to 20 carbon atoms and the ethylene oxide: alcohol molar ratio is from 25:1 to 75:1.

The active detersive and softening phosphoric esters are $R^1O(CH_2CH_2O)_mPO(OM)_2$, designated (I), wherein $R_1$ is a higher alkyl of 14 to 20 carbon atoms, m is from 1 to 6 and M is an alkali metal or ammonium and $[R^1O(CH_2CH_2O)_m]_2POOM$ (II). Of these compounds it is considered that the diester is more effective as a softener and the monoester is a more powerful detergent. However, the combination appears to be especially useful and both products possess detersive and softening properties. Additionally, although essentially nonfoaming they do not interfere with the foaming of anionic detergents in which they may be formulated. In addition to the polyethoxylated esters mentioned, there will usually be present with these, alkyl phosphates of formulas $R^2OPO(OM)_2$ (III) and $(R^2O)_2POOM$ (IV) wherein $R^2$ is of 6 to 10 carbon atoms. These help to disperse and solubilize the polyethoxy phosphoric esters and facilitate their manufacture and use. The useful softening detergent product based on a combination of such materials will contain from 0.1 to 5%, preferably 0.5 to 2% of I, 0.1 to 3%, preferably 0.5 to 1.5% of II, 0.1 to 2%, preferably 0.2 to 1% of III and 0.1 to 1%, preferably 0.2 to 0.5% of IV. Preferred ratios of I:II and III:IV are 4:1 to 2:3, preferably 2:1 to 1:1, and 9:1 to 1:1, preferably 4:1 to 3:2 for the total of I and II to the total of III and IV. In these compounds $R^1$ is preferably higher alkyl of 16 to 18 carbon atoms, m is preferably 1 or 2 to 4, M is preferably sodium and $R^2$ is preferred to be of about 8 carbon atoms and most preferably is 2-ethylhexyl. Acid forms of the phosphoric esters are also usable and will normally be converted to sodium salts in the crutcher by reaction with a base.

The nonionic material which makes the organic phosphoric ester softeners sprayable and which prevents them from interfering with the flow properties of the finished spray dried product is one having balanced hydrophilic and lipophilic groups so that it is soluble in water while yet being sufficiently hard and of "waxy" physical properties so as to make the phosphoric esters less tacky. Such a material is a higher aliphatic alcohol polyethoxyethanol wherein the alcohol is of 14 to 20 carbon atoms and the ethylene oxide:higher alcohol molar ratio is from 25:1 to 75:1. Preferably, such compounds have higher alkoxy groups of 16 to 18 carbon atoms with an ethylene oxide:higher alkoxy molar ratio of 40:1 to 60:1, most preferably about 50:1. The proportion of such a nonionic in the final spray dried detergent is usually from 1 to 10%, preferably 1 to 5% and most preferably about 1 to 3%. The content of this nonionic material in the product will generally be from 20 to 200% of the total content of the mono- and diesters identified as I and II. Calculated on the basis of the mixture of all the organic phosphoric esters, the ratio of the nonionic to such total (I+II+III+IV) will be from 1:3 to 3:1 and preferably will be from 1:3 to 1:1. The fact that the addition of such nonionic compound, which also possesses useful detergent properties, improves the flowability of the product is highly unexpected because nonionics themselves have often caused tackiness and poor flow properties in detergents. Also, they often fume during spray drying operations, being lost out the tower top, causing pollution complaints and resulting in uneconomic operations. Yet, in the present process it appears that the nonionic and phosphoric esters complement each other so that improved flowability is obtained and losses of nonionic are diminished. The reasons for such effects are not established although it is possible that the particular combinations result in an increased melting point of the mixture over that of the phosphoric ester mixture alone.

Although the phosphoric ester mixture and the nonionic compound or mixture of such nonionic compounds may be separately added to crutcher mixes to be sprayed it may sometimes be preferable to utilize 2 to 10 parts of the described phosphoric ester mixture and 1 to 10 parts of the nonionic, with the ratio of such mixture being from 1:3 to 3:1, to produce compositions which may be added to the crutcher mixes to give them the desirable properties of phosphoric esters without the poor flow characteristics thereof.

The other components of detergent materials to be spray dried will normally include synthetic anionic organic detergent and inorganic builder salt for such detergent. Also generally present will be filler salt(s) and a minor proportion of moisture. Of the builder salts a preferred one is alkali metal silicate.

The most useful of the synthetic anionic organic detergents are the alkali metal higher alkyl benzene sulfonates. The higher alkyl may be of 10 to 18 carbon atoms but is preferably of 12 to 15 carbon atoms and is most preferably about 12 carbon atoms. Although useful detergency and desirable foaming are obtained when from 1 to 50% of such detergents are present, for best flowability and acceptable detergency there will usually be employed 2 to 25%, preferably 5 to 20% thereof. Normally the detergent will be in the form of a water soluble salt, preferably an alkali metal salt, e.g., sodium dodecyl benzene sulfonate, and most preferably the higher alkyl group will be linear.

The higher alkyl benzene sulfonate detergents are of excellent compatibility with the described phosphoric acid esters and the mentioned nonionics. Preferably the anionic detergent utilized will be linear alkyl benzene sulfonate (LAS), which is an excellent detergent, comparatively free flowing (compared to highly branched alkyl benzene sulfonates) and readily biodegradable. However, if desired, other such anionic detergents may be utilized, normally in partial replacement of the alkyl benzene sulfonate. Thus, up to 50% of the alkyl benzene sulfonate may be replaced with higher fatty alcohol sulfates, paraffin sulfonates, olefin sulfonates, sulfated higher fatty alcohol polyethoxyethanols, sulfated alkyl phenoxy polyethoxyethanols, monoglyceride sulfates, salts of higher fatty acid amides of N-methyl taurines, salts of higher fatty acid esters of isethionic acid, etc. Salt-forming ions are generally alkali metal or ammonium and the higher fatty groups, olefins and paraffins are of 12 to 20 carbon atoms, with the side chain alkyls on the phenoxies being of 6 to 9 carbon atoms. Mixtures of such detergent materials may also be used and the total proportions of anionic detergent employed will be the same as previously given for the alklyl benzene sulfonates.

The silicate builder salts of the detergent compositions will be of an $M_2O:SiO_2$ ratio of 1:1.5 to 1:3.2, preferably 1:1.8 to 1:2.8 and most preferably 1:2.0 to 1:2.4. Such silicates may contribute anticorrosion properties to the product and when employed in greater proportions are effective builders, especially useful in compositions which are low in inorganic phosphate builder salts. The preferred silicates are alkali metal silicates, e.g., sodium silicates. From 2 to 50% of alkali metal silicate will be utilized, preferably 5 to 20% when the silicate is not the primary builder salt present. Of the non-silicate builder salts the most effective one is sodium tripolyphosphate, and 5 to 60% may be employed, preferably 20 to 45%. However, in applications wherein inorganic phosphate builder salts are to be avoided, other builders may be used, often in the same general proportions, although in some cases the content of builder may be reduced to half that specified above. Such other builders include alkali metal, preferably sodium carbonate, bicarbonate, nitrilotriacetate, 2-hydroxyethyl iminodiacetate, citrate, gluconate, etc. Preferably such compounds are completely neutralized. In some cases, EDTA may be employed, generally in smaller proportions than the NTA mentioned.

Of the filler salts that can be present, sodium sulfate is usually the best. It is found as a byproduct in commercial slurries of various anionic detergents and has desirable water sorbing properties, since it hydrates readily. Thereby, it improves flowability. However, other filler salts such as sodium chloride and sodium acetate and fillers such as starches, talcs, silicas, etc., may also be present. Such fillers, especially if sodium sulfate is employed, may constitute from 2 to 50% of the product but will more normally be from 5 to 25% thereof.

The percentage of moisture in the product will generally be from 1 to 15% but preferably is from 2 to 10%, being low enough so as not to interfere with free flow of the detergent beads.

Of various adjuvants which may be present in the detergent to contribute their supplementary effects, some representative ones include fluorescent dyes, whitening agents, bleaches, germicides, fungicides, enzymes, soil suspending agents, flow promoting compounds, tarnish inhibitors, perfumes, colarants, stabilizers, antioxidants, and buffers. The proportions of adjuvants utilized will usually be less than 20%, frequently less than 10% and normally will not exceed 8% of the compositions, with individual adjuvants normally being present to the extent of less than 2%, except for sodium perborate bleach beads, which may be post added to a greater extent, normally up to 30%.

The detergent compositions made may be in hollow bead form and if desired, can have supplemental flow promoting agents incorporated with them, especially if they are mixed with bleaches after spraying. Spray dried compositions are normally in the 6 to 140 mesh, U.S. Standard Sieve Series range (3.36 mm. to 105 microns), preferably being about 8 to 100 mesh (2.38 mm. to 149 microns). Up to 20% of the product may be outside these ranges but normally at least 80% will be in a range such as described and preferably this figure will be over 99%.

The spray drying operation, with the addition of the nonionic flow promoter in the crutcher, is not much different from normal spray drying. The nonionic compound does not adversely affect the viscosity of the curtcher mix and hence, normal crutching temperatures and conditions may be employed, together with the usual spraying pressures. Thus, the temperature in the crutcher during and after the addition of the phosphoric esters and nonionic will be from about 50° to 90° C., the spraying pressure will be from 200 to 600 lbs./sq. in. (14 to 42 kg./sq. cm.) and the drying gas temperature will be from 100° to 300° C., either in countercurrent or concurrent flow. Spraying is through nozzles of such size that under the spraying conditions the droplets formed and dried will pass through No. 6 U.S. Standard Sieves and fail to pass No. 140 U.S. Standard Sieves, to the extent of at least 80%.

The crutcher mix from which the droplets are sprayed may be of suitable solids content and it is preferred that this be from 25 to 80% solids, usually from 35 to 75% thereof. Because only moisture is lost in the drying operation, the proportions of solids in the final product correspond to such proportions in the crutcher mix.

After drying, the product is cooled and any materials to be post-added may be applied, such as perfume and other constituents previously mentioned. Cooling is normally to about room temperature and it is desirable that it should be to less than 40° C., to avoid any tackiness due to the phosphoric esters. When cooled beads are examined, before post-addition of any other ingredients, they are found to be smooth surfaced and there is no evidence of migration of the phosphoric ester to such surfaces, such as is observable when the nonionic material is not included in the crutcher mix. However, if nonionic is post-added, instead of being included in the crutcher, a tacky product is often produced.

The order of addition of the various materials to the crutcher is not critical although it is desirable to maintain a sufficient proportion of water in the mix to maintain fluidity. In a preferred addition, water and a neutralizing agent such as sodium hydroxide, if the acid form of the phosphoric esters is used, may be added first, followed by the anionic detergent, usually in slurry form, and the mixture of phosphoric esters, in acid form. Subsequently then, sodium silicate, sodium sulfate various other additives, moisture and nonionic may be blended in, with the non-silicate builder salts, such as pentasodium tripolyphosphate, frequently being added last. Yet, in other situations the phosphoric esters, in acid or neutralized form, may be the last constituent. Of course, when pre-neutralized phosphoric esters are employed there is no need for caustic soda or other neutralizing agent being present. Such other useful neturalizing agents include sodium carbonate, sodium bicarbonate, other alkaline salts and ammonia but the carbon dioxide-releasing salts represent additional processing problems and therefore, the hydroxides are preferred.

The acid forms of the mixed phosphoric esters which may be used are available under the name Berel TVM-729 from Berel Aktiebolaget (Sweden). Methods for the manufacture of such phosphate esters and mixtures thereof are described in British Pat. No. 1,012,418. In producing the neutral salts, normally a stoichiometric proportion of neutralizing agent will be employed, which will also neutralize any unreacted phosphoric acid which may be present, usually to a minor extent, e.g., 3% or less of the ester content.

The detergent compositions made are of improved flowability, as compared to those of the same formulas from which the nonionic material has been omitted (usually being replaced by sodium sulfate or anionic detergent). They are of improved washing capability, due to the presence of the nonionic compound. Additionally, they are satisfactorily foaming and when compared to control compositions of similar formulas except for the omissions of the phosphoric esters, are found to be much more effective in softening washed laundry. The compositions do not cake excessively on standing, unlike controls from which the nonionic has been omitted. Thus, the surprisingly beneficial results of the present invention allow the production of commercially acceptable spray dried detergent-softening compositions which previously were unattainable.

The following examples illustrate the invention but do not limit it. Unless otherwise mentioned all temperatures are in °C. and all parts are by weight.

EXAMPLE 1

The following materials are charged to a crutcher in the order given.

| | Kilograms |
|---|---|
| Water | 75 |
| Sodium hydroxide, 50% aqueous solution | 10 |
| * Sodium linear dodecyl benzene sulfonate, aqueous slurry | 133 |
| ** Mixed phosphoric esters | 25 |
| Sodium silicate ($Na_2O:SiO_2$ = 1:2) | 70 |
| Sodium sulfate, anhydrous | 57 |
| Adjuvants (fluorescent brighteners, antiredeposition agent (CMC), antioxidant and pigment) | 15 |
| Water | 125 |
| Higher alkanol ($C_{16-18}$) polyethoxy ethanol (EtO:ROH = 50:1) | 15 |
| Pentasodium tripolyphosphate | 235 |

* 51.5% Solids, of which 40%, on the solids basis, is sodium linear dodecyl benzene sulfonate, the balance being sodium sulfate.
** 10 Parts I, 7.5 parts II, 4.5 parts III and 3 parts IV or Berol TVM-729, acid forms.

The crutcher temperature is held at 65° C. by a steam jacket and crutching is effected for about ten minutes after addition of all the materials. After crutching of about five batches they are sent to a holding tank and then are pumped under a pressure of 500 lbs./sq. in (35 kg./sq. cm.), through spray nozzles into a spray drying tower of countercurrent type in which the temperature ranges from 300° C. at the bottom to 100° C. at the top. The nozzles used are changed until beads sprayed are substantially (over 80%) within the 6 to 140 mesh range, U.S. Standard Sieve Series. At the bottom of the tower the beads, at about 90° C. are initially cooled partially and are then subsequently cooled in an airlift as they are moved to a product collector, from which they are further transferred to filling equipment, packaged, warehoused, shipped, sold and used. In the airlift the temperature is lowered to about 30° C. On storage, the product does not cake and it is found to be free flowing although it does contain such a proportion of phosphoric ester detergent-softener as would normally cause such a product to lump, cake and flow poorly, in the absence of the nonionic. The product is a good detergent and when cotton towels are washed with it it foams satisfactorily, cleans them excellently and leaves them soft, apparently due to the content of the phosphoric esters in the detergent composition.

When variations are made in the formula, whereby pre-neutralized phosphoric esters are employed, such neutralization being effected with sodium hydroxide, and when the proportion of sodium silicate is doubled and the pentasodium tripolyphosphate is replaced with 130 parts of trisodium nitrilotriacetate and 35 parts of sodium sulfate, similar improvement is flowability over a control product from which the nonionic is omitted, (being replaced by sodium sulfate) results. Such improvements are also obtainable when different proportions of the phosphoric esters within the described ranges of this specification are utilized and when such changes are made in the anionic detergent, silicate, builder salt and nonionic and their contents. Also, such are also the results when the particular anionic detergent is replaced to the extent of 25% by lauryl alcohol sulfate, higher olefin sulfonate or coconut oil alkoxy polyethoxy sulfate, all as the sodium salts. When potassium or ammonium salts are employed flowability is not as good but is acceptable providing that the nonionic compound is present.

In the control experiments with respect to the first formulation given above the formula and procedure described are exactly the same except for the replacement of the nonionic with sodium sulfate in one case and with the anionic detergent in the other. In both such instances the control product produced is unacceptably tacky and causes a buildup in the air-lift and in the product collector, making the composition and the process useless for commercial production. Similar controls for the other embodiments of the invention described result in similarly poorly flowing products which require the post-addition of flow improving agents to make them of any use at all.

EXAMPLE 2

| | Kilograms |
|---|---|
| Water | 382 |
| * Sodium hydroxide, 50% aqueous solution | 24 |
| Sodium linear dodecyl benzene sulfonate, aqueous slurry | 230 |
| ** Mixed phosphoric esters | 62 |
| Sodium silicate | 171 |
| Sodium sulfate | 197 |
| Adjuvants | 46 |
| Pentasodium tripolyphosphate | 432 |

Three batches of the above formula are produced and sent to a holding tank but at that point the production is halted because the spray dried product made is so tacky that it is impossible to handle in the production equipment. The formulation is then modified by the addition of 26 kilograms of ethoxylated $C_{16-18}$ Oxo alcohol in which the ethylene oxide:alcohol ratio is about 55:1. The slurry produced (all operations are the same as in Example 1) is spray dried to a satisfactory free flowing powder of the desired 8 to 100 mesh sieve size. The detergent beads resulting are satisfactory in cleaning power and soften cottons and other textiles washed with them, simultaneously helping to make such materials resistant to accumulations of static charges.

EXAMPLE 3

| | Kilograms |
|---|---|
| * Sodium linear alkyl ($C_{12-13}$) benzene sulfonate, aqueous slurry | 220 |
| Sodium silicate ($N_2O:SiO_2$ = 1:2.35) | 91 |
| Sodium hydroxide, 50% aqueous solution | 8 |
| Water (60° C.) | 124 |
| Higher alkyl ($C_{16-18}$) polyethoxyethanol (EtO:ROH = 50:1) | 11 |
| Adjuvants | 15 |
| Sodium sulfate | 31 |
| Pentasodium tripolyphosphate | 215 |
| ** Phosphoric ester mixture (as in Example 1) | 25 |

About 10 batches of the above formulation are prepared by the method described in Example 1 and are spray dried to a satisfactory free flowing product of particle size within the 3.36 to 100 micron diameter range. During the run for two crutcher mixes the nonionic component is omitted, at which time when such product is spray dried the resulting beads are very tacky and operations have to be halted to allow cleanout before resumption of spraying with the original formulation containing the nonionic compound.

In a variation of this example, the phosphoric ester in acid form is initially neutralized and dried, after which it is blended with the nonionic and the combination is added to the crutcher mix in place of the caustic soda, nonionic and phosphoric ester (acid form) shown in the formula. The product resulting is of essentially the same properties as that of the above example.

The invention has been described with respect to various illustrations and examples thereof but is not to be limited to them because it will be evident to one of skill in the art how modifications may be made, equivalents employed and substitutes utilized without departing from the spirit or scope of the invention.

What is claimed is:

1. A method of producing free flowing spray dried built heavy duty synthetic organic detergent compositions containing mixed mono- and diesters of phosphoric acid and higher alkoxy polyethoxy ethanol, in salt form, which function to soften fabrics consisting essentially of, by weight, (a) 0.1 to 5% $R^1O(CH_2CH_2O)_mPO(OM)_2$, (b) 0.1 to 3% $[R^1O(CH_2CH_2O)_m]_2POOM$, wherein $R^1$ is higher alkyl of 14 to 20 carbon atoms, m is from 1 to 6 and M is an alkali metal or ammonium, (c) 2 to 25% of a $C_{10}$ to $C_{18}$ alkali metal benzene sulfonate detergent and (d) 5 to 60% inorganic builder salt for such detergent which comprises admixing with such materials in an aqueous crutcher mix from which the composition is to be spray dried from 1 to 3% higher alkyl alcohol polyethoxyethanol wherein the alcohol is of 14 to 20 carbon atoms and the ethylene oxide:alcohol molar ratio is from 25:1 to 75:1, the ratio of the total quantities of (a) and (b) to said polyethoxyethanol being from 0.5:1 to 5:1.

2. A method according to claim 1 wherein the crutcher mix is crutched at an elevated temperature, sprayed in small droplet form, with the droplets being of such a size that over 80% of the spray dried particles produced therefrom pass through a No. 6 U.S. Standard Sieve and fail to pass a No. 140 U.S. Standard Sieve, the droplets are dried by contacting them with a hot gas and they are cooled to room temperature.

3. A method according to claim 1 wherein the crutcher mix comprises from 35 to 70% solids which include a total of from 2 to 5% of (a), (b), (c) and (d), wherein $R^1$ is higher alkyl of 16 to 18 carbon atoms, m is from 1 to 4, M is sodium, $R^2$ is of about eight carbon atoms, the ranges or proportions recited in claim 12 relating to (a), (b), (c) and (d) are 2:1 to 1:1 and 4:1 to 3:2; the alkali metal alkyl benzene sulfonate is sodium linear docedyl benzene sulfonate and the percentage thereof is 5 to 20%; the alkali metal silicate is sodium silicate, the $Na_2O:SiO_2$ ratio of which is from 1:2 to 1:2.4 and the percentage of which is 5 to 20%; the nonsilicate builder salt is pentasodium tripolyphosphate, of which 20 to 45% is present; the higher aliphatic alcohol polyethoxyethanol is one wherein the ethylene oxide:-higher alkanol molar ratio is about 50:1; and the ratio of higher alkoxy polyethoxyethanol to the total of the named organic phosphoric esters is from 1:3 to 1:1.

4. A method according to claim 1 wherein the mix is crutched at a temperature of 50° to 90° C., spray dried into a heated drying gas which is at a temperature of 100° to 300° C., cooled to a temperature below 40° C.

and after cooling, the spray dried beads are screened so as to be within the No. 6 to 140 U.S. Standard Sieve range.

5. A method according to claim 4 wherein the product contains from 5 to 25% of sodium sulfate.

6. A method according to claim 1 including the compounds (C)$R^2OPO(OM)_2$ and (d) $(R^2O)_2POOM$ wherein $R^2$ is alkyl of 6 to 10 carbon atoms, the proportion of (a):(b) and (c):(d) being from 4:1 to 2:3, the proportion of the total of (a) and (b) to the total of (c) and (d) being from 9:1 to 1:1.

7. A method according to claim 6 including from 5 to 20% alkali metal silicate of $M_2O:S_iO_2$ ratio of 1:1.5 to 1:3.2.

8. A method according to claim 6 wherein said alcohol contains 16 to 18 carbon atoms and the ethylene oxide:alcohol molar ratio is 40:1 to 60:1.

* * * * *